United States Patent [19]

Menditto

[11] 3,962,738

[45] June 15, 1976

[54] STROLLER BLANKET

[76] Inventor: Barbara Menditto, 289 Jerome Ave., Oakhurst, N.J. 07755

[22] Filed: July 11, 1974

[21] Appl. No.: 487,619

[52] U.S. Cl. ..... 5/334 R; 5/343; 2/77

[51] Int. Cl.[2] ..... A47G 9/00

[58] Field of Search ..... 5/334 R, 343; 2/77, 2/80, 83, 84

[56] References Cited

UNITED STATES PATENTS

| | | | |
|---|---|---|---|
| 1,863,256 | 6/1932 | Snoddy | 5/334 |
| 2,227,751 | 1/1941 | Idleman | 5/334 R |
| 2,442,105 | 5/1948 | Vacheron | 5/334 R |
| 2,705,326 | 4/1955 | Lahnstein | 2/83 |
| 2,744,253 | 5/1956 | Freedman | 2/80 |
| 3,555,567 | 1/1971 | Owen | 2/80 |

*Primary Examiner*—Paul R. Gilliam
*Assistant Examiner*—Andrew M. Calvert
*Attorney, Agent, or Firm*—Fidelman, Wolffe & Waldron

[57] ABSTRACT

An infant stroller blanket composed of a rectangularly shaped front and back section of blanket material having lower and upper portions is disclosed. The lower front and back portions are joined together and are bifurcated to form leg elements. The front upper portion has a zipper fastener or the like along its longitudinal center line and the corners of the upper portions of the front and back sections may be joined together by a clasp. Adjustable features are provided to shorten the legs if desired, and draw strings may be employed at the mid portions and in the legs to draw in the covering around the child more snugly.

Additional optional features are the provisions of a hood, forming the legs boot shaped, providing elastomer soles for the leg portions, and providing additional fasteners in the leg portions.

10 Claims, 2 Drawing Figures

STROLLER BLANKET

BACKGROUND OF THE INVENTION

This invention relates to a blanket particularly adapted for use by infants and small children in a stroller or carriage.

DESCRIPTION OF THE PRIOR ART

Infants and young children are very commonly placed in strollers or carriages and taken along on walks by their parents or guardians. Quite often small children are taken for rides on bicycles or sleds. In cold weather, the infant must be wrapped warmly for comfort. The simplest method for accomplishing this is to wrap the child in a blanket. This is quite effective but suffers from some disadvantages in that the child cannot be quickly and easily extricated from the blanket folds, and in addition any loose ends can be caught in the wheels of the carriage, bicycle or stroller. Other means in the form of sacks or sleeping bags are employed, but here the infant is constricted in his movements, which can prove to be quite disconcerting to an active child.

It is an object of this invention to provide a stroller or carriage blanket which provides extensive freedom of movement to an infant enveloped within said blanket, from which the infant may be readily removed and which provides separate leg portions adapted to receive each leg.

It is a further object of this invention to provide means to adjust the length of the leg portions.

It is a further object to provide means to readily open the blanket in order to take care of the baby's needs or to remove him therefrom.

Further objects will become apparent from the following description and claims.

SUMMARY OF THE INVENTION

This invention relates to a blanket structure of general rectangular configuration having front and back sections. The lower portion is bifurcated, thereby forming two legs. The top and upper sides are open and the front and back portions are detachably fastened together at the top by clasps at the upper corners. Appropriate means, such as zippers or the like, are provided at the front and, if desired, along the back and legs, to enable the blanket structure to be opened and closed as desired. Detachable hood means may be fastened to the upper edge of the back section.

DESCRIPTION OF THE PREFERRED EMBODIMENT

Figure 1:
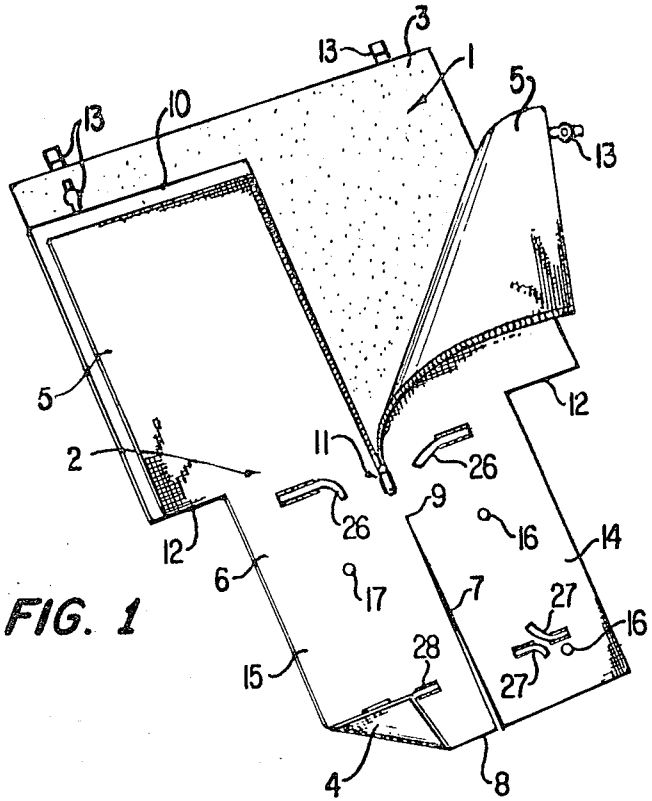
FIG. 1 is a perspective view of the blanket.

As illustrated in FIG. 1, the blanket structure of this invention consists of a generally rectangular back section 1 and a similar but somewhat shorter front section 2. The material employed may be any suitable textile fabric commonly employed to make blankets or cold weather-wear, as for example wool, quilted nylon, acrylic, etc. Back section 1 consists of a generally rectangular upper portion 3 and a lower portion 4. Portions 3 and 4 are integrally joined along their common boundary. However, if desired, detachable fastenings such as zippers may be employed to join the portions together. The transverse dimension of 4 is at most equal to the transverse dimension of 3 but can be fractionally shorter as shown in the embodiment of FIG. 1. Section 2 likewise consists of a generally rectangular upper portion 5 and a lower generally rectangular portion 6. Lower portion 6 has the same shape and dimensions as 4, and upper portion 5 has the same transverse dimension as 3 but is somewhat shorter longitudinally. Portions 5 and 6 are integrally joined along their common boundary. Portions 4 and 6 are slit along the longitudinal center line as shown at 7, to form bifurcated lower portions. The slit extends from the lower edge 8 to point 9 which is located at a position between the middle and the top of lower portions 4 and 6. Generally, it is located closer to the top. The perimeters of the bifurcated portions are joined together to form legs.

The upper section 2 has a zipper fastener 26 at its longitudinal center line, extending from the top edge 10 of portion 5 to point 11 in portion 6. Point 11 is spaced from point 9 a short distance apart, no more than a few inches. Instead of zipper fasteners, other means may be employed such as Velcro, snap fasteners, ties, etc.

In the embodiment shown in FIG. 1, upper portions 3 and 5 are wider than lower portions 4 and 6 forming shoulders 12, the edges of which are joined together. Releaseable fastening means 13 are attached to the upper corners of portions 3 and 5 whereby said portions may be retained on the child occupant. The fastening means shown are clasps in FIG. 1, but it is apparent that any suitable equivalent means may be employed, such as ties, snaps, buttons, etc. The edges of the blanket are reinforced, as is usual, by binding. Legs 14 and 15, located at the lower portion, have snaps 16,16 and 17,17 respectively (only one snap 17 being shown). The legs may be shortened for a younger child by forming a cuff which is retained in place by means of the snap fasteners.

Figure 2:
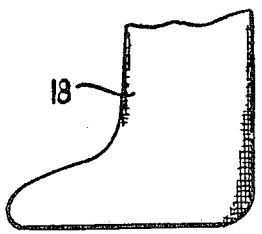
FIG. 2 shows a modification of the leg portion, showing a boot shape.
Figure 3:
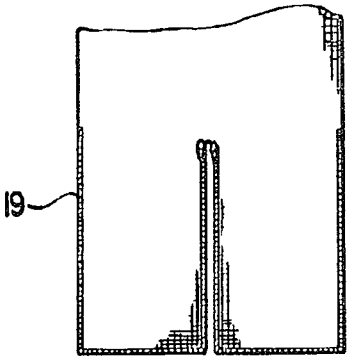
FIG. 3 shows a further modification, wherein the outside perimeter of the legs are fastened by zippers.
Figure 4:
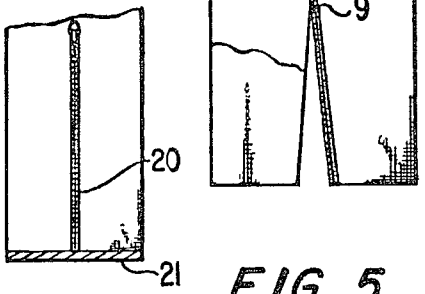
FIG. 4 is a plan view of the leg with a zipper in the center therof.
Figure 6:
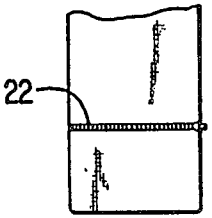
FIG. 6 is a view of the leg showing a transverse zipper.
Figure 7:
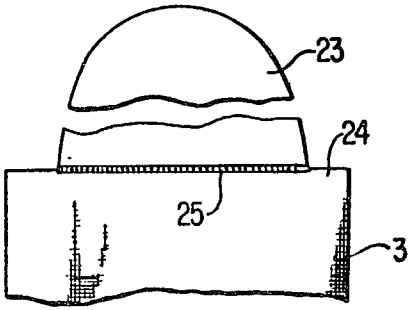
FIG. 7 is a view showing a detachable hood attached to the blanket.

Various modifications of this embodiment may be made. In FIG. 2, the leg portion is shown in the form of a boot 18, to conform more closely to the child's foot. FIG. 3 shows zipper 19 around the entire perimeter of the legs. This enables the child to be diapered without disturbing the rest of the blanket arrangment. FIG. 4 shows a zipper 20 down the front center of a leg and also a modification of the leg bottom wherein a generally circular sole portion 21 is provided made of an elastomeric material. This sole arrangment enables an older child to walk about. Like sole portions (not shown) may be provided as well for the boot shape of FIG. 2. FIG. 6 shows a transverse zipper fastener 22 near the bottom of the leg. As shown in FIG. 7, a hood 23 may be detachably fastened to upper edge 24 of back portion 3 by means of a zipper fastener 25.

Figure 5:
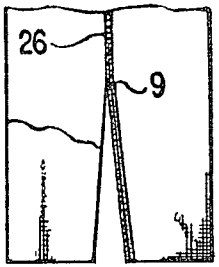
FIG. 5 is a view showing the front center line zipper of FIG. 1 extending down a leg.

If desired, draw strings as shown at 26 in FIG. 1 may be incorporated to draw the blanket snugly around the child occupant, or in the case of the leg draw strings 27 and 28 to shorten the legs. As shown in FIG. 5, zipper fastener 26 may be extended beyond point 11 to run down the inner portion of leg 13 or 15. This would enable a greater proportion of the front of the blanket to be folded back.

From the above description it is apparent that the present invention includes a blanket cover for infants and young children which is compact, has no loose ends, is readily adjustable, and can easily be placed around a child and removed thereafter.

What is claimed:

1. A child or infant covering comprising:

1. a back section having:

a. an upper generally rectangular portion with its transverse dimension somewhat larger than its longitudinal dimension;

b. a lower generally rectangular portion joined to the upper rectangular portion at a common transverse boundary and having a bottom edge;

c. said lower rectangular portion having a transverse dimension no more than that of the upper rectangular portion, and having a longitudinal dimension at least equal to said transverse dimension;

d. said lower rectangular portion having a longitudinal slit at its longitudinal center line extending from the bottom edge to a crotch at a distance more than half but less than the entire longitudinal dimension of said lower rectangular portion, whereby a bifurcated lower back portion is formed;

2. a front section having a top edge comprising:

a. an upper generally rectangular portion somewhat smaller longitudinally than the upper rectangular back portion and having the same transverse dimension as the latter;

b. a bifurcated lower front portion having the same shape and dimensions as the bifurcated lower back portion and joined to the upper front portion along a common transverse boundary;

c. said upper front section and at least some of the lower front section being divided into two portions along their longitudinal center lines, means for joining together and unfastening said two portions;

3. said front and back lower portions being joined together along the edges thereof to form closed leg portions having sides and bottoms;

4. the transverse dimensions of the upper front and back sections and of the lower front and back sections ranging from being equal to each other to having the upper section somewhat larger than the lower section, and in the case of the latter having segments of the upper sections projecting beyond the ends of the lower section;

5. any segments of the front and back upper portions projecting beyond the front and back lower portions being joined together at the lower edges of said projecting portions; and

6. means to fasten the upper edges of the front and back upper portions at the corners thereof.

2. The covering of claim 1 wherein the means for joining together and unfastening the said two portions recited in (2) (c) comprise means extending from the top edge of the upper front section to a short distance above the crotch.

3. The covering of claim 1 wherein the means for joining together and unfastening the said two portions recited in (2) (c) comprise means extending from the top edge of the upper front section to the crotch and then along an inner edge of one of the legs.

4. The covering of claim 1 wherein the upper back portion has fastening means for attaching a hood, and a hood means attached thereto.

5. The covering of claim 1 wherein the upper back portion has opening and closing means along a longitudinal center line.

6. The covering of claim 1 wherein the leg portions have adjustable means for lengthening and shortening said portion.

7. The covering of claim 1 wherein opening and closing means are provided at the bottom of each of the bifurcated leg portions.

8. The covering of claim 1 wherein the front and back lower bifurcated portions are fastened together by opening and closing means.

9. The covering of claim 1 having a draw string extending transversely at the mid portion.

10. The covering of claim 6 wherein the adjustable means comprise snaps which are adapted to retain the legs in their adjusted position.

* * * * *